US005360326A

United States Patent [19]

Okuda et al.

[11] Patent Number: 5,360,326

[45] Date of Patent: Nov. 1, 1994

[54] TWIN HELICAL BLADE FLUID COMPRESSOR

[75] Inventors: Masayuki Okuda; Takayoshi Fujiwara; Takashi Honjo, all of Tokyo, Japan

[73] Assignee: Kabushiki Kaisha Toshiba, Kawasaki, Japan

[21] Appl. No.: 112,367

[22] Filed: Aug. 27, 1993

[30] Foreign Application Priority Data

Aug. 28, 1992 [JP] Japan ..... 4-229883

[51] Int. Cl.[5] ..... F01C 21/08

[52] U.S. Cl. ..... 418/220; 418/188; 417/356

[58] Field of Search ..... 418/220, 188, 173; 417/356

[56] References Cited

U.S. PATENT DOCUMENTS

| | | | |
|---|---|---|---|
| 4,871,304 | 10/1989 | Iida et al. | 418/220 |
| 5,090,874 | 2/1992 | Aikawa et al. | 417/356 |
| 5,217,361 | 6/1993 | Fujiwara et al. | 418/220 |
| 5,242,287 | 9/1993 | Fujiwara | 417/356 |

FOREIGN PATENT DOCUMENTS

| | | | |
|---|---|---|---|
| 0019684 | 1/1990 | Japan | 418/220 |
| 0088994 | 4/1991 | Japan | 418/220 |

*Primary Examiner*—Richard A. Bertsch
*Assistant Examiner*—Charles G. Freay
*Attorney, Agent, or Firm*—Cushman, Darby & Cushman

[57] ABSTRACT

A fluid compressor having a cylinder, columnar rotating body, first and second spiral grooves, first and second recessed grooves, first and second spiral blades slidable in a radial direction of the columnar rotating body and fitted in the first and second spiral grooves. A drive means is provided for causing a rotational movement of the cylinder and the columnar rotating body synchronously with each other. Stoppers extend from the cylinder into first and second recessed grooves whose wall portions are located adjacent to a respective first turn of the second and first spiral grooves and advanced by 180° from a respective second and first spiral grooves. The first and second stoppers engage respective end portions of the spiral blades during the rotational movements of the cylinder and the columnar rotating body. With this arrangement of the wall portions of the first and second recessed grooves, interference between adjacent first and second grooves is prevented and refrigerating gas compressed in an operating chamber does not leak or return to a first suction port provided in a central portion of the columnar rotating body.

3 Claims, 2 Drawing Sheets

TWIN HELICAL BLADE FLUID COMPRESSOR

BACKGROUND OF THE INVENTION

1. Field of the Invention

The present invention relates to a helical blade type fluid compressor which can be used for compressing refrigerant gas in a refrigeration cycle.

2. Description of the Related Art

A helical blade type compressor is a closed compressors. A compressor of this type is disclosed in U.S. Pat. No. 4,871,304 . The compressor has a compression section which is driven by a motor and arranged in a closed case. The compression section is provided with a cylinder which is rotated together with a rotor in a motor. A piston, having a center axis eccentric to the axis of the cylinder, is rotatably housed in the cylinder. A spiral or helical groove is formed on the outer circumference of the piston in the axial direction. The pitches of the spiral groove are gradually narrowed along the distance of the piston from one end to the other. A blade having appropriate elasticity is fitted into the spiral groove.

A space between the cylinder and the piston is partitioned into a plurality of operating chambers by the blade. The volumes of these operating chambers are gradually decreased along the distance from the suction side to the discharge side of the cylinder. When the cylinder and the piston are rotated in unison by the motor, refrigerant gas in the refrigeration cycle is drawn into the operating chamber through the suction side of the cylinder. The gas thus drawn in is successively fed to the operating chambers located on the discharge side of the cylinder. As the gas is being fed to the operating chambers it is also being compressed in the operating chambers. The gas is then discharged into the closed case through the discharge end of the cylinder.

In the above-described compressor, however, the pressure of the refrigerant gas in the operating chamber located on the discharge side of the cylinder is higher than the pressure of the gas in the operating chamber located on the suction side of the cylinder. The difference in pressure increases the friction between the piston and bearing. Thus a large drive force is needed to rotate the cylinder and piston.

A compressor disclosed in U.S. Pat. No. 5,090,874 is an improvement of the above-mentioned compressor. First and second spiral grooves are formed on the outer circumference of the piston. The first groove extends from the center to one end of the piston while the second groove extends from the center to the other end of the piston. First and second blades are fitted into first and second spiral grooves, respectively. The refrigerant gas that is drawn into the cylinder is introduced into the center portion of piston and separately supplied to the right and left portions of operating chambers. The refrigerant gas is transferred and compressed in two directions which are opposed to each other. Therefore, the thrust forces which act on the piston from both ends to the center of the cylinder cancel each other out.

SUMMARY OF THE INVENTION

The object of the present invention is to provide a compact fluid compressor having first and second blades, respectively fitted into first and second grooves formed on a rotary body which prevents the starting ends of spiral grooves from interfering with each other.

In order to achieve the objective, a fluid compressor according to the present invention comprises: a cylinder having first and second discharge ends; a rotating body located in the cylinder which extends in an axial direction of the cylinder and is eccentric thereto, and is rotatable while a part of the rotating body is in contact with an inner circumference of the cylinder; said rotating body having first and second spiral grooves on an outer circumference thereof; said first groove having a first starting end located substantially in the middle of the rotating body, and extending from the first starting end toward the first discharge end of the cylinder; said second groove having a second starting end located apart from said first starting end by 180° in the circumferential direction of the of the rotating body, and extending from the second starting end toward the second discharge end of the cylinder; said first and second grooves being turned in directions opposite to each other and pitches thereof being gradually narrowed from the first and second starting ends to the first and second discharge ends of the cylinder, respectively; said rotating body further having first and second recessed grooves on the outer circumference thereof; said first and second recessed grooves are in said first and second grooves at the first and second starting ends, respectively; said first and second recessed grooves having wall portions substantially perpendicular to the axis of said rotating body, wherein a distance between the wall and the first starting end of said first groove satisfies the following formula:

$$a+b-c/2>d$$

wherein:

a denotes a distance between a location of the second starting end to a half-turn of the second groove advanced by 180° from the second starting end;

b denotes an offset between the first starting end and the second starting end being located apart by 180° in the circumferential direction of the rotating body;

c denotes a width of the second groove; and d denotes a distance between the wall portion of the first recessed groove and the first starting end; first and second spiral blades fitted into the first and second grooves respectively to be slidable in a radial direction of the rotating body; said first and second spiral blades having outer circumferential surfaces in contact with the inner circumference of the cylinder, and dividing a space between the inner circumference of the cylinder and an outer circumference of the rotating body into a plurality of operating chambers; engaging means for engaging said first and second spiral blades at respective end portions; said engaging means including first and second tubular members each attached to said cylinder and extending to the first and second recessed grooves for engaging the starting end portions of said first and second spiral blades; respectively, guide means for guiding operation fluid into an area adjacent to the first and second starting ends of the first and second grooves; and drive means for rotating the cylinder and rotating body synchronously with each other so as to feed the operating fluid, which introduced into said area through the guide means, to the first and second discharge ends of the cylinder through the operating chambers and to discharge the operating fluid outside from the first and second discharge ends.

BRIEF DESCRIPTION OF THE DRAWINGS

The accompanying drawings, which are incorporated in and constitute a part of the specification, illustrate a presently preferred embodiment of the invention, and together with the general description given above and detailed description of the preferred embodiment given below, serve to explain the principles of the invention.

DETAILED DESCRIPTION OF THE PREFERRED EMBODIMENT

An embodiment of the present invention will now be explained with reference to the accompanying drawings.

Figure 1:
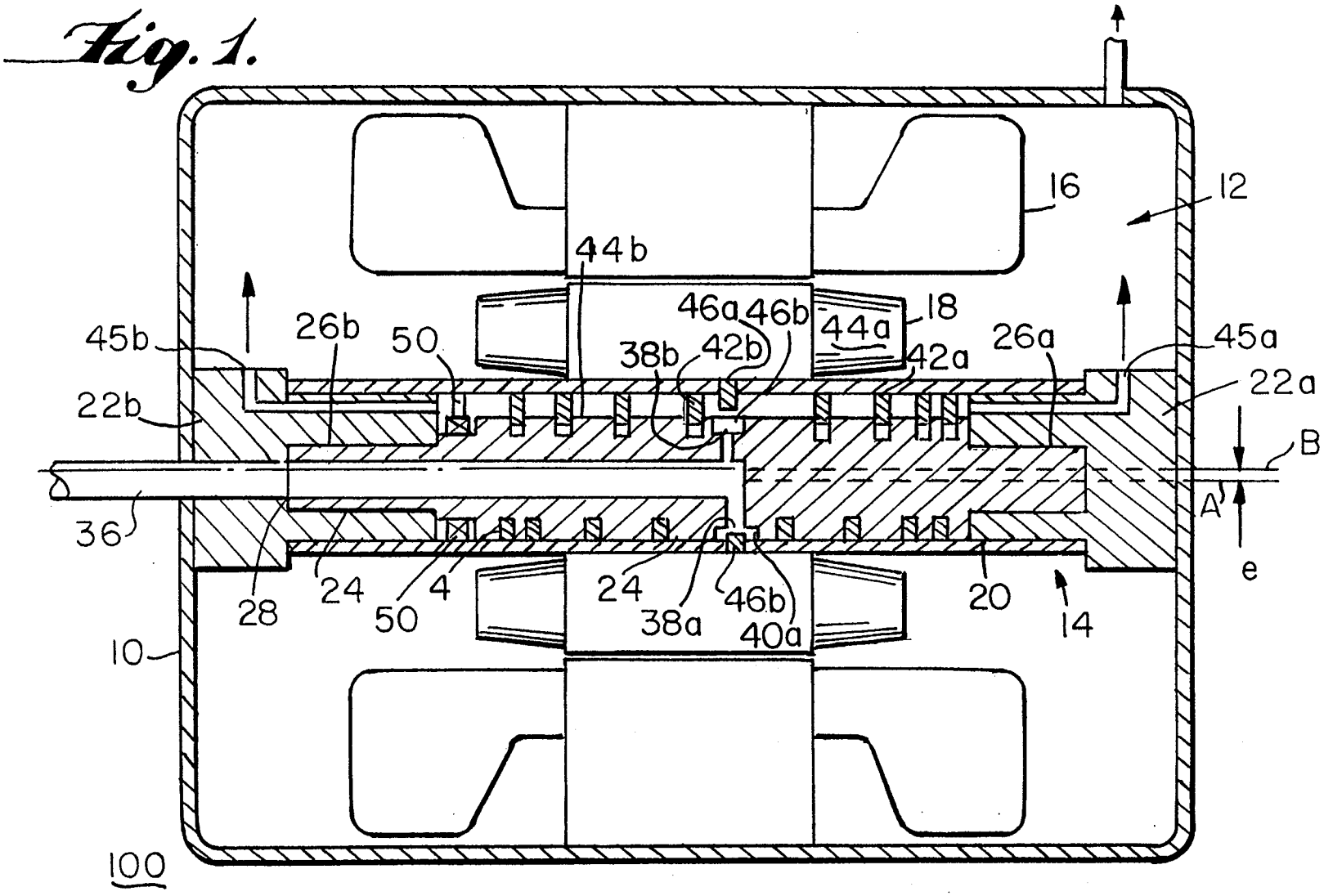
FIG. 1 is a sectional view showing a compressor according to the present invention.

FIG. 1 shows an embodiment in which the present invention being applied to a helical blade type compressor 100 for compressing a refrigerant in a refrigerating cycle.

Compressor 100 includes a motor section 12, compression section 14 and is arranged in case 10. Motor section 12 includes a ring-shaped stator 16 fixed to the inner face of case 10. A ring-shaped rotator 18 is located inside stator 16.

Compression section 14 has a cylinder 20. Rotor 18 is coaxially fixed to the outer circumference of the cylinder 20. Both ends of the cylinder 20 are closed so as to be air tight and are rotatably supported by bearings 22*a*, 22*b* which are fixed to the inner face of the case 10. More specifically, right end or first discharge end of cylinder 20 is rotatably fitted onto the bearing 22*a*, while the left end or second discharge end thereof is rotatably fitted onto bearing 22*b*. Cylinder 20 and rotator 18 are therefore fixed to supported by bearing 22*a* and 22*b*, coaxially to stator 16.

A columnar rotating body 24 having a diameter smaller than that of cylinder 20 is arranged in cylinder 20 and extends between bearing 20*a* and 20*b*. Rotating body 24 has a center axis A made eccentric to the center axis B of cylinder 20 by a distance e. Part of the outer circumference of rotating body 24 is in contact with the inner circumference of cylinder 20. Smaller-diameter portions 26*a* and 26*b*, at both ends of rotating body 24, are rotatably supported by the bearings 22*a* and 22*b*.

Figure 2:
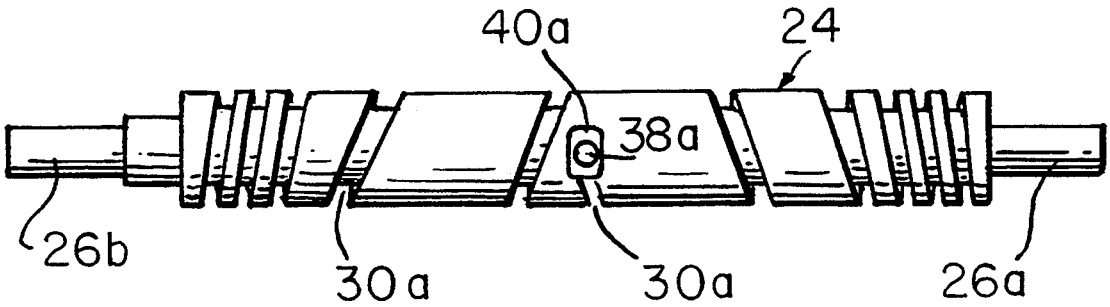
FIG. 2 is a side view of a rotating body of the compressor.

Cylinder 20 and rotating body 24 are connected to each other through an Oldahm's mechanism 50 which serves as a rotational transmitting means. When motor section 12 is energized to rotate cylinder 20 together with rotor 18, the rotating force of cylinder 20 is transmitted to rotating body 24 by means of Oldahm's mechanism 50. As a result, body 24 is rotated in cylinder 20 while the outer circumference thereof is partially in contact with the inner circumference of cylinder 20. As shown in FIG. 2, a first groove 30*a* is formed on the outer circumference of rotating body 24, extending from the middle portion of rotating body 24 to the right end thereof, while a second groove 30*b* is also formed on rotating body 24 to left end thereof. The pitches of first groove 30*a* gradually become narrower at a certain rate along the distance from the middle portion of rotating body 24 to the left end thereof or to the second discharge end of cylinder 20. First groove 30*a* has the same turns as that of second groove 30*b*. However, first groove 30*a* is turned in a direction opposite to that direction in which second groove 30*b* is turned. First and second grooves 30*a* and 30*b* have starting ends 32*a* and 32*b* which are positioned near the middle of rotating body 24. Starting end 32*a* and 32*b* are set apart from each other by 180° in the circumferential direction of rotating body 24. Further, starting end 32*a* is set apart from starting end 32*b* in axial direction along center axis B of rotating body 24. Each starting end 32(*a*) and 32(*b*) is adjacent to a half turn of the groove advanced by 180° from the other starting end, but is positioned not to cross the groove. Each groove has s width and depth which are uniform over its entire length, and the side faces of the groove are perpendicular to the longitudinal axis of rotating body 24.

Rotating body 24 has s suction passage 28 therein, which extends from the left end of small-diameter portion 26*b* to the middle of rotating body 24. The right end of suction passage 28 attaches to a suction tube 36 of the refrigerating cycle. The left end of suction passage 28 attaches to first and second suction ports 38*a* and 38*b*. As shown in FIG. 1, first and second suction ports 38*a* and 38*b* are located in recessed grooves 40*a* and 40*b*, which are formed on the outer circumference of rotating body 24. First and second recessed grooves 40*a* and 40*b* are positioned first and second spiral grooves 30*a* and 30*b*, respectively. The center of first recessed groove 40*a* is regarded as starting end 32*a* of first spiral groove 30*a*. Similarly, the center of second recessed groove 40*b* is regarded as second starting end 32*b* of second spiral groove 30*b*. The location of suction ports 38*a* and 38*b* may not be limited to placement in recessed grooves 40*a* and 40*b*, instead, they are formed in another area on the circumference of rotating body 24.

First and second spiral blades 42*a* and 42*b* are fitted into grooves 30*a* and 30*b*, respectively. Blades 42*a* and 42*b* are formed of elastic material, and can be fitted into corresponding grooves 30*a* and 30*b* by utilizing their elasticity. The thickness of each blade 42*a* or 42*b* is substantially equal to the width of the corresponding groove 30. Each of blades 42*a* and 42*b* are movable in the radial direction of rotating body 24 along the corresponding groove 30. The outer circumference of each blade 42*a* and 42*b* is closely in contact with the inner circumference of cylinder 20.

The space defined between the inner circumference of cylinder 20 and the outer circumference of rotating body 24 and extending from the middle of cylinder 20 to the first discharge side thereof, is partitioned into a plurality of operating chambers 44*a* by first blade 42*a*. Operating chambers 44*a* are shaped substantially in the form of a crescent, extending along the blade 42*a* from the contact portion between rotating body 24 and the inner circumference of cylinder 20 to the next contact portion. The volumes of these operating chambers 44*a*, are reduced gradually with distance from the middle of cylinder 20 toward first discharge side thereof.

Similarly, the space defined between the inner circumference of cylinder 20 and the outer circumference of rotating body 24, and extending from the middle of cylinder to the second discharge side thereof, is partitioned into a plurality of operating chambers 44*b* by second blade 42*b*. Operating chambers 44*b* are shaped substantially in the form of a crescent, extending along the blade 42*b* from the contact portion between rotating body 24 and the inner circumference of cylinder 20 to the next contact portion. The volumes of these operating chambers 44b are reduced gradually with distance from the middle of cylinder 20 toward second discharge side thereof.

First and second members 46a and 46b extending toward first and second recessed grooves 40a and 40b are provided on cylinder 20, respectively. First member 46a, extended from cylinder 20, engages a first starting end of first spiral blade 42a. Similarly second member 46b, extended from cylinder 20 engages a second starting end of second spiral blade 42b. Each member 46a and 46b serves to stop the movement of the first and second ends of spiral blades 42a and 42b, which is caused by the rotation of rotating body 24. Discharge holes 45a and 45b are formed in bearings 22a and 22b, respectively and are opened to case 10.

Figure 3:
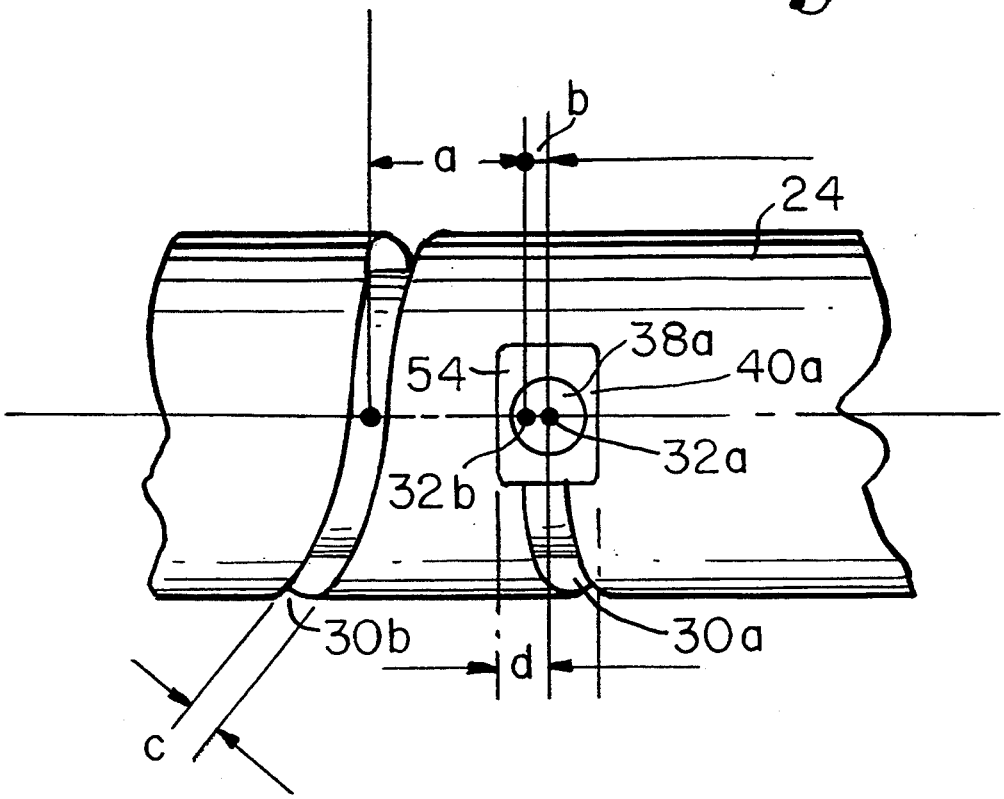
FIG. 3 is an enlarged side view of the rotating body.

As shown in FIG. 3, first recessed groove 40a has a wall portion 54 substantially perpendicular to the axis of rotating body 24. The location of wall portion 54 is selected so as not to cross second groove 30b. If wall portion 54 crosses second groove 30b, the refrigerating gas compressed in operating chamber 44b leaks or is returned to the suction port. This is because the sealing condition between the spiral groove fitted blade and recessed groove are not ideal and high pressure developed in the operating chamber allows the gas leakage. The distance between wall portion 54 which is adjacent to second groove 30b and first start end 32a of first groove 30a satisfies the following formula:

$$a+b-c/2>d$$

wherein;

a denotes a distance between a location of second starting end 32b to a half-turn of second groove 30b advanced by 180° from second starting end 32b;

b denotes an offset between first starting end 32a and second starting end 32b being located apart by 180° in the circumferential direction of rotating body 24;

c denotes a width of second groove 30b; and d denotes a distance between wall portion 54 of first recessed groove 40a and first starting end 32a.

The following is a description of the operation of compressor 100 constructed in this manner.

When motor section 12 is switched on, rotator 18 rotates together with cylinder 20. The rotational force of cylinder 20 is transmitted to rotating body 24 through Oldahm's mechanism 50, thereby synchronizing the rotation of rotating body 24 with cylinder 20. Rotating body 24 is thus rotated while its outer circumference is partially in contact with the inner circumference of cylinder 20. First and second blades 42a and 42b are also rotated together with rotating body 24. Blades 42a and 42b rotate while keeping their outer circumferences in contact with the inner circumference of cylinder 20. Therefore, blades 42a and 42b are pushed into the corresponding grooves 30a and 30b as they approach contact portions between the outer circumference of rotating body 24 and the inner circumference of cylinder 20, and emerge from grooves 30a and 30b as they go away from the contact portions. When the compression section 14 is made operative, refrigerant gas is sucked into cylinder 20 by passing through suction tube 36, passage 28 and first and second suction ports 38a and 38b. The gas is confined in the operating chamber 44a which is defined between the first and second turns of first blades 42a, and in operating chamber 44b, which is defined between the first and second turns of second blade 42b. As rotating body 24 rotates, the gas in operating chamber 44a is successively fed into the next operating chamber 44a while being confined between the two adjacent turns of blade 42a. Similarly, the gas in operating chamber 44b is successively fed into the next operating chamber 44b while being confined between the two adjacent turns of blade 42b. The volumes of operating chamber 44a are gradually reduced with distance from the middle of cylinder 24 to the first discharge end thereof. Similarly volumes of operating chamber 44b are gradually reduced with distance from the middle of cylinder 20 to the second discharge end. Therefore, the gas confined in operating chamber 44a is gradually compressed as it is delivered to the first discharge end of cylinder 20, while the gas confined in the operating chamber 44b is gradually compressed as it is delivered to the second discharge end of cylinder 20. The refrigerant gas is thus compressed and discharged into case 10.

As described above, starting ends 32a and 32b of first and second spiral grooves 30a and 30b on rotating body 24 are set apart from each other by 180 degree in the circumferential direction of rotating body 24. The gases compressed in the operating chambers 44a and 44b are alternately compressed and alternately discharged.

According to compressor 100 having the above described arrangement, the refrigerant gas drawn into the middle portion of cylinder 20 is compressed while being fed in two opposite directions, that is, to the first and second discharge ends of cylinder 20. When the gas is being compressed, thrust forces heading from first discharge end of cylinder 20 to the middle thereby and from the second discharge end of cylinder 20 to the middle thereof act on rotating body 24, and they are balanced with each other because they are equal to each other. This can prevent rotating body 24 from being displaced whereby it would push its end face against bearings 22a and 22b.

First member 46a is received in first recessed groove 40a and engages to the end of first spiral blade 42a while rotating body 24 is rotated, thereby, maintaining the end of first blade 42 in first groove 30a. Similarly, second member 46b is received in second recessed groove 40b and engages to the end of second spiral blade 42b while rotating body 24 is rotated, thereby, maintaining the end of second blade 42b in second groove 30b. Since the position of wall portion 54 of first recessed groove 40a which is adjacent to second groove 30b is selected to satisfy the formula described above, interference between adjacent first and second grooves 30a and 30b is prevented. Therefore, the refrigerating gas compressed in operating chamber 44b does not leak or return to first suction port side 38a. Similarly, the refrigerating gas compressed in operating chamber 44a does not leak or return to second suction port side 38b.

The compressor having arrangements described above has the operating chambers of which volumes are gradually decreased from the middle of the rotating body to the end thereof, however the present invention can be applied to a compressor having operating chambers of which volumes are gradually increased from the middle of a rotating body to the end thereof. In this instance, refrigerant gasses are successively fed from each ends of the rotating body to the middle thereof.

The compressor of the present invention can be applied to other systems as well as the refrigerating cycle.

Additional advantages and modifications will readily occur to those skilled in the art. Accordingly, various modifications may be effected without departing from the spirit or scope of the general inventive concept as defined by the appended claims and equivalents.

What is claimed is:

1. A fluid compressor comprising:

a cylinder having first and second discharge ends;

a rotating body located in said cylinder which extends in an axial direction of said cylinder and is eccentric thereto, and is rotatable while a part of said rotating body is in contact with an inner circumference of said cylinder, said rotating body having first and second spiral grooves on an outer circumference thereof, said first groove having a first starting end located substantially in the middle of said rotating body, and extending from said first starting end toward said first discharge end of said cylinder, and said second groove having a second starting end located apart from said first starting end by 180 degrees in the circumferential direction of said rotating body, and extending from said second starting end toward said second discharge end of said cylinder, said first and second grooves being turned in directions opposite to each other and itches thereof being gradually narrowed from said first and second starting ends to said first and second discharge ends of said cylinder, respectively, said rotating body further having first and second recessed grooves on the outer circumference thereof, said first and second recessed grooves are proximate to said first and second starting ends, respectively, said first and second recessed grooves having wall portions substantially perpendicular to the axis of said rotating body, wherein a distance between said wall portion and said first starting end of said first groove satisfies the following formula:

$$a+b-c/2>d$$

wherein:

a denotes a distance between a location of said second starting end to a half-turn of said second groove advanced by 180° from said second starting end;

b denotes an offset between said first starting end and said second starting end being located apart by 180° in the circumferential direction of said rotating body;

c denotes a width of said second groove; and d denotes a distance between said wall portion of said first recessed groove and said first starting end;

first and second spiral blades fitted into said first and second grooves respectively to be slidable in a radial direction of said rotating body, said first and second spiral blades having outer circumferential surfaces in contact with said inner circumference of said cylinder, and dividing a space between said inner circumference of said cylinder and an outer circumference of said rotating body into a plurality of operating chambers;

engaging means for engaging said first and second spiral blades at respective end portions, said engaging means including first and second tubular members each attached to said cylinder and extending to said first and second recessed grooves for engaging the starting end portions of said first and second spiral blades; respectively;

guide means for guiding operation fluid into an area adjacent to said first and second starting ends of said first and second grooves; and drive means for rotating said cylinder and said rotating body synchronously with each other so as to feed the operating fluid, which is introduced into said area through said guide means, to said first and second discharge ends of said cylinder through said operating chambers and to discharge the operating fluid outside from said first and second discharge ends.

2. A fluid compressor according to claim 1, wherein said guide means further comprises:

a suction port opened to the outer circumference of said rotating body and located between said first and second spiral grooves; and a suction passage formed in said rotating body and having an end attached to said suction port.

3. A fluid compressor according to claim 1, wherein said guide means further comprises:

first and second suction ports opened to the outer circumference of said rotating body and located in said first and second recessed grooves, respectively; and a suction passage having an end attached to said first and second suction ports.

* * * * *